United States Patent [19]

Harrison

[11] Patent Number: 4,940,534

[45] Date of Patent: Jul. 10, 1990

[54] FROTH FLOTATION COLUMN

[75] Inventor: John M. M. Harrison, Macon, Ga.

[73] Assignee: J. M. Huber Corporation, Borger, Tex.

[21] Appl. No.: 382,302

[22] Filed: Jul. 20, 1989

[51] Int. Cl.[5] ..... B03D 1/16; B03D 1/22; B03D 1/24

[52] U.S. Cl. ..... 209/169; 209/170; 261/93

[58] Field of Search ..... 209/169, 170; 210/219, 210/221.2, 221.1; 261/93, 123

[56] References Cited

U.S. PATENT DOCUMENTS

| | | | |
|---|---|---|---|
| 1,124,853 | 1/1915 | Callow . | |
| 1,312,754 | 8/1919 | Rowand | 209/169 |
| 2,141,862 | 12/1938 | Hall | 209/169 |
| 2,148,445 | 2/1939 | Drake | 209/169 |
| 2,178,239 | 10/1939 | McKenna . | |
| 2,217,231 | 10/1940 | Morse | 209/169 |
| 2,304,270 | 12/1942 | Mead | 209/169 |
| 2,433,592 | 12/1947 | Book | 209/169 |
| 2,792,939 | 5/1957 | Myers | 209/169 |
| 3,202,281 | 8/1965 | Weston . | |
| 3,371,779 | 3/1964 | Hollingsworth et al. . | |
| 3,464,552 | 9/1969 | Warman . | |
| 4,212,730 | 7/1980 | Brooks . | |
| 4,287,054 | 9/1981 | Hollingsworth . | |
| 4,290,886 | 9/1981 | Takakuwa | 209/169 |
| 4,394,258 | 7/1983 | Zipperian . | |
| 4,472,271 | 9/1984 | Bacon, Jr. . | |
| 4,477,338 | 10/1984 | Hellmann . | |
| 4,643,852 | 2/1987 | Koslow . | |
| 4,699,740 | 10/1987 | Bollenrath | 261/93 |

FOREIGN PATENT DOCUMENTS

| | | | |
|---|---|---|---|
| 638380 | 12/1978 | U.S.S.R. | 209/169 |
| 899145 | 1/1982 | U.S.S.R. | 209/169 |

*Primary Examiner*—David L. Lacey
*Assistant Examiner*—Thomas M. Lithgow
*Attorney, Agent, or Firm*—Wall and Roehrig

[57] ABSTRACT

A flotation chamber separates fine kaolin particles or the like by flotation out of a slurry. A generally cylindrical column has an inlet for injecting slurry into the column, a froth launder at an upper end of the column, and a tailings outlet at the lower end of the column. A draft tube is vertically oriented within the column and has upper and lower open ends. A sparger within the draft tube injects air into the slurry within the draft tube, and a rotary impeller immediately above the top end of the draft tube produces a fine bubble in the slurry and permits quiescent zones in the slurry above and below the position of the impeller. Aeration of the slurry supplied to the impeller lowers power draw.

6 Claims, 2 Drawing Sheets

FROTH FLOTATION COLUMN

BACKGROUND OF THE INVENTION

This invention relates to froth flotation chambers or columns, and especially to apparatus of the type in which fine particle size mineral impurities as the brownish mineral anatase can be separated by flotation from an aqueous slurry of kaolin clay, a white mineral which has a higher commercial value with increased whiteness.

Many types of flotation equipment have been proposed for separating mixtures of discrete mineral particles from a slurry containing both types of particles. Generally, air bubbles are formed in the slurry. These air bubbles contact the mineral particles, some of which adhere to the bubble. This froth rises to the top of the vessel containing the slurry. Then, the froth is effectively separated from the remaining slurry; likewise, the other mineral particles to be separated remain in the slurry and flow to the bottom of the chamber as tailings. Various flotation chambers have been described in the literature, namely, in U.S. Pat. No. 4,477,338 to Hellmann, U.S. Pat. No. 1,112,853 to Callow, U.S. Pat. No. 3,202,281 to Weston, U.S. Pat. No. 3,464,552 to Warman, U.S. Pat. No. 3,371,779 to Hollingsworth et al., U.S. Pat. No. 2,178,239 to McKenna, U.S. Pat. No. 4,287,054 to Hollingsworth, U.S. Pat. No. 4,394,258 to Zipperian, U.S. Pat. No. 4,472,271 to Bacon, Jr., and U.S. Pat. No. 4,212,730 to Brooks.

It has been desired to produce an improved flotation chamber suitable for use in beneficiating kaolin, in which very fine bubbles are injected to aerate the slurry, and which has quiescent zones both above and below the level of bubble generation.

OBJECTS AND SUMMARY OF THE INVENTION

Accordingly, it is an object of this invention to provide froth flotation apparatus in which slurry is aerated before it encounters the impeller to reduce power draw on the impeller.

It is another object of this invention to provide froth flotation apparatus which produces a fine bubble and which has good quiescent zones both above and below the impeller.

It is a more specific object of this invention to provide fine particle flotation apparatus, especially for use in processing kaolin.

It is another object to allow a deep froth for good drainage of slurry.

It is still another object to improve froth cleaning and recovery with wash water.

It is a further object to avoid recycling of collected particles, i.e., froth, back into the impeller, thereby avoiding breakoff of the collected particles from the air bubbles.

It is yet a further object to provide independent control of slurry recycle rate, bubble size, and gas volume.

It is a still further object of this invention to provide fine particle flotation apparatus in which the above-mentioned independent control is carried out by the draft tube, the impeller/draft tube clearance, by the impeller speed, and/or directly by a control valve.

It is still another object of this invention to provide flotation apparatus which can employ relatively low pressure blower air rather than higher pressure (and higher cost) compressor air.

According to an aspect of this invention, a flotation chamber separates fine particles by flotation out of a slurry. A generally cylindrical column has an inlet for adding slurry into the column, a froth launder at an upper end of the column for removing froth containing the fine particles, and an outlet at the lower end of the column for removing tailings. A draft tube is vertically oriented within the column and has upper and lower open ends. A sparger within the draft tube injects air into the slurry within the draft tube. A rotary impeller immediately above the top end of the draft tube has a rotor plate with a vertical axis that is connected to a rotating shaft. There are a number of radial blades affixed to the underside of the rotor plate. This produces fine bubbles and permits quiescent zones in the slurry both above and below the position of the impeller.

The above and other objects, features and advantages of this invention will be more fully understood from the ensuing description of a preferred embodiment, which should be considered in connection with the accompanying Drawing.

DETAILED DESCRIPTION OF THE PREFERRED EMBODIMENTS

Figure 1:
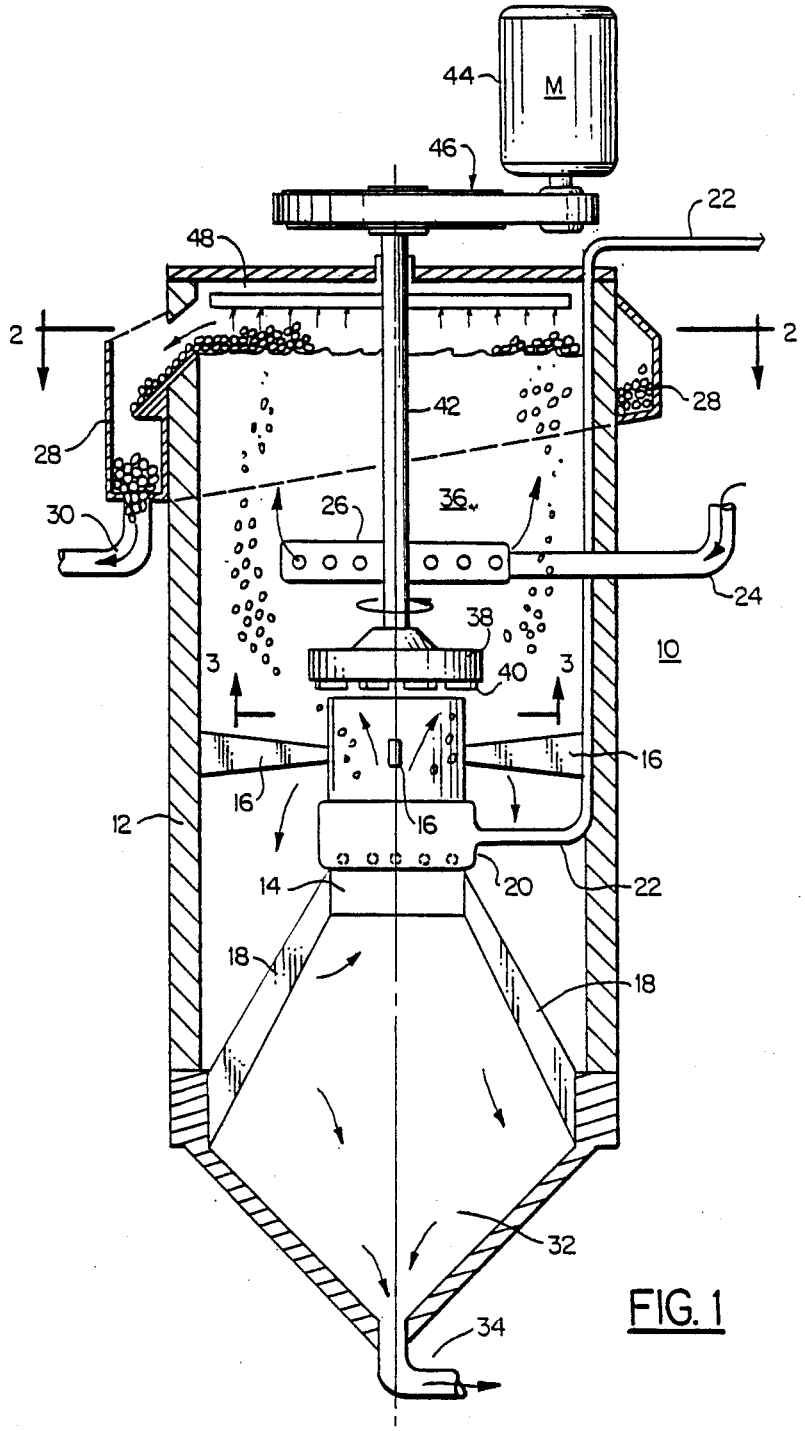
FIG. 1 is a sectional elevation showing a flotation column or chamber according to one preferred embodiment of this invention.
Figure 2:
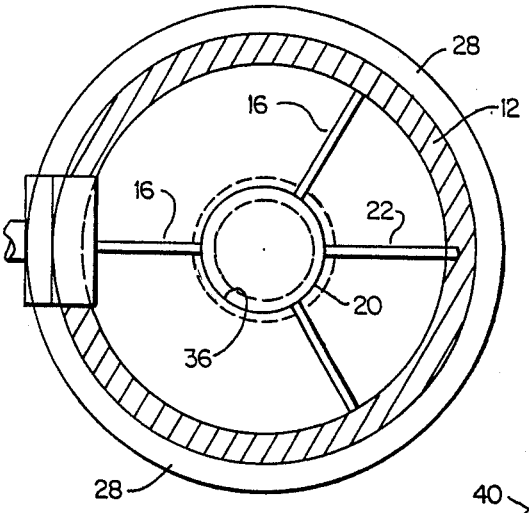
FIG. 2 is a sectional plan view taken along line 2—2 of FIG. 1.

With reference to the Drawing, and initially to FIGS. 1–4 thereof, a flotation chamber 10 has a generally cylindrically-walled vessel 12 with a cylindrical draft tube 14 vertically oriented within it, and supported by upper struts 16 and lower struts 18. The draft tube 14 has open top and bottom ends. A sparger 20 is centrally located in a horizontal plane within the draft tube 14 for injecting bubbles into slurry within the draft tube 14. An air line 22 supplies air from a blower to the sparger 20.

Figure 3:
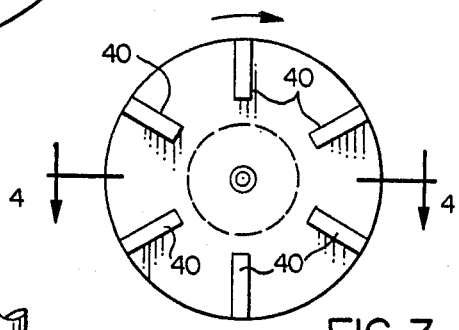
FIG. 3 is a plan view of the impeller rotor, taken along lines 3—3 of FIG. 1.
Figure 4:
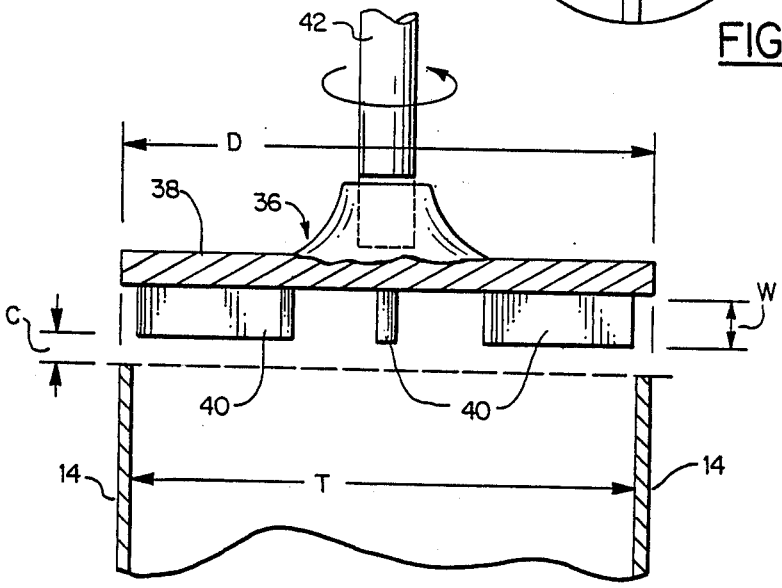
FIG. 4 is an enlarged sectional view of the impeller 10 taken along line 4—4 of FIG. 3.

A feed supply line 24, e.g., from a previous stage, supplies slurry, plus any required make-up water or dilution, to an inlet channel 26, here an annular channel disposed centrally along the wall of the vessel 12 above a turbulent zone created by the impeller. An overflow froth launder 28 located circumferentially around the vessel's top collects the froth or foam from the top of the flotation chamber 10 and supplies the same as a concentrate of fine particles through a froth outlet pipe 30 to a subsequent processing stage. As an option, a mechanical froth collecting device, which can be of any of several well-known designs, moves the froth into the launder 28. A tailings outlet 32 at the bottom of the flotation chamber 10 is coupled to a tailings outlet pipe 34. A rotary impeller 36 is situated above the upper end of the draft tube 14. This impeller 36 is formed of a rotor plate 38 or disc having a diameter approximately the same as the diameter of the draft tube 14. As shown in FIG. 3, there are a number of generally radial blades or vanes 40 affixed onto the under surface of the plate 38. In this embodiment there are six vanes 40 spaced at sixty degree intervals. A vertical rotary shaft 42 supplies rotary energy to the impeller plate from a motor 44 connected by means of a belt drive 46 to the shaft 42. The drive can also be a direct, varispeed, or bottom entry drive. Also shown in at the top of the vessel 12 is a water wash 48 for cleaning the froth. In this embodiment, deaerated recycle slurry enters the draft tube 14 at its lower end, and is aerated by the sparger 20. Then the aerated slurry rises to the impeller 36 which produces a fine bubble. The air bubbles adhere to the fine particles which rise with the froth and are collected in the launder 28, while tailings will tend to descend to the outlet 32.

The ratio of impeller vane width W to impeller diameter D can be varied to control shear and pumping characteristics of the impeller, while the clearance, C, between the draft tube and impeller vanes 40 is adjustable to aid in controlling internal recycle rate through the draft tube 14. By supplying aerated slurry to the rotor, the power draw to the impeller is reduced, and there is good contact between the fine particles and the small bubbles. Because of this, it is possible to employ a high-shear impeller with low pumping design to produce fine bubble at low power. Thus, with this design there is a good quiescent zone above and below the level of the impeller 36.

While this invention has been described in detail with reference to an exemplary preferred embodiment thereof, it should be recognized that the invention is not limited to that precise embodiment. Rather, many modifications and variations would present themselves to those skilled in the art without departing from the scope and spirit of this invention, as defined in the appended claims.

What is claimed is:

1. A flotation apparatus for separating particles by flotation out of a slurry comprising a column having an inlet for adding slurry into the column, and a froth launder at an upper end of the column for removing froth containing said fine particles, and an outlet at a lower end of the column for removing tailings from said column, a draft tube vertically oriented within the column and having upper and lower open ends, sparger means for injecting air into the slurry in the tube between the lower and upper ends of the draft tube, means for supplying air to the sparger means, and a rotary impeller immediately above the top end of the draft tube, said impeller including a rotary plate having a vertical rotational axis and means for rotating the same in said slurry to produce fine bubbles and permitting quiescent zones in the slurry above and below the position of the impeller.

2. A flotation apparatus according to claim 1 wherein said column is generally cylindrical.

3. A flotation apparatus according to claim 2 wherein said draft tube is substantially cylindrical.

4. A flotation apparatus according to claim 1 wherein said rotary impeller includes a plurality of radial vanes affixed on the underside of said plate.

5. A flotation chamber apparatus according to claim 4 wherein there are six said vanes.

6. A flotation apparatus according to claim 1 wherein the draft tube is cylindrical and said draft tube has an inside diameter between 75 and 115% of the outside diameter of the impeller.

* * * * *